United States Patent [19]

Flynn

[11] 4,166,304

[45] Sep. 4, 1979

[54] PAINT BRUSH

[76] Inventor: Francis X. Flynn, 1830 Harvey Ln., East Meadow, N.Y. 11554

[21] Appl. No.: 881,571

[22] Filed: Feb. 27, 1978

Related U.S. Application Data

[63] Continuation-in-part of Ser. No. 760,632, Jan. 19, 1977, abandoned.

[51] Int. Cl.[2] ..... A46B 3/00

[52] U.S. Cl. ..... 15/191 R; 15/191 A

[58] Field of Search ..... 15/143–145, 15/190–193, 176, 159, 199, 248

[56] References Cited

U.S. PATENT DOCUMENTS

| | | | |
|---|---|---|---|
| 403,542 | 5/1889 | Loonen | 15/199 X |
| 758,063 | 4/1904 | Gruneberg | 15/190 |
| 1,128,667 | 2/1915 | Puy | 15/199 |
| 1,214,025 | 1/1917 | Grafftey | 15/191 X |
| 1,435,358 | 11/1922 | Wheeler | 15/199 |
| 1,928,929 | 10/1933 | Craig | 15/145 |
| 2,516,778 | 7/1950 | Kreidenweiss | 15/191 R |
| 2,782,909 | 2/1957 | McNamara | 15/248 R |

FOREIGN PATENT DOCUMENTS

| | | | |
|---|---|---|---|
| 1930 | of 1880 | United Kingdom | 15/176 |

*Primary Examiner*—Peter Feldman

*Attorney, Agent, or Firm*—Robert D. Farkas

[57] ABSTRACT

A paint brush that includes a two part assembly, a first part having a removable handle and the second part including the brush bristle head and a plurality of channels for flushing the ends of the bristles embedded in the head with a solvent when the head has been disassembled from the handle and stored in a solvent carrying container.

8 Claims, 3 Drawing Figures

PAINT BRUSH

BACKGROUND OF THE INVENTION

This application is a Continuation-in-part of prior U.S. Application Ser. No. 760,632, filed Jan. 19, 1977 now abandoned.

This invention relates to paint brushes; more particularly to a two-part paint brush and container wherein the bristle bearing head may be removed from a handle portion and irrigated and cleaned whilst being stored within a solvent carrying tank. A plurality of channels communicates to the embedded end of the bristles, within the head, thereby facilitating the cleaning and the storage of same.

The prior art teaches a variety of paint brushes. Typical of these is the patent to C. F. Craig, Ser. No. 1,928,929, issued Oct. 3, 1933, teaching a detachable handle and paint brush assembly having a port through which a cleaning fluid may be transmitted to within the interior of the paint brush head such that the port communicates to the proximal end of the bristles and communicates to the opening in which the handle is assembled to the head of the brush. Such brush requires having available pressurized liquids, such as water or solvents in order to effectively irrigate the bristle ends attached to the brush.

SUMMARY OF THE INVENTION

It is accordingly an object of the instant invention to provide for a new and improved paint brush.

It is another object to provide for one having the attributes as aforedescribed.

It is a further object to provide for the same at relatively little cost thereby making the same generally available.

These and other objects and advantages of the invention will become more apparent from a consideration of the following detailed disclosure and claims and by reference to the accompanying drawing, in which:

Figure 2:
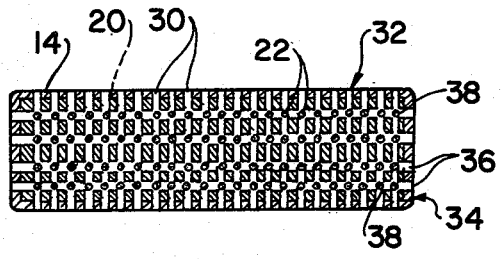
FIG. 2 is a cross-section view taken along line 2—2 of FIG. 1.
Figure 1:
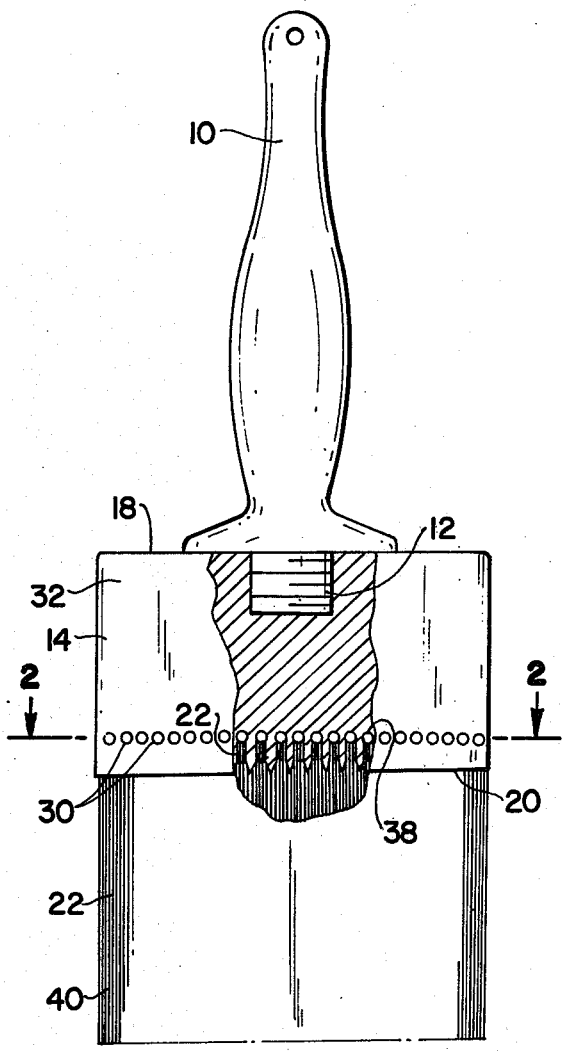
FIG. 1 is a front elevational view partly in section.
Figure 3:
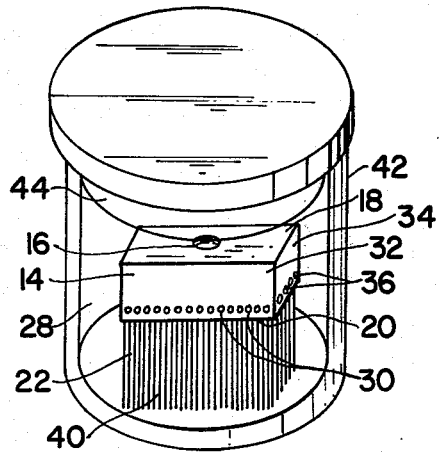
FIG. 3 is a perspective view of the bristle head in storage.

Broadly speaking, the instant invention includes the provision of a paint brush assembly, comprising a head portion, one end of the head portion being removably attachable to a handle means, the opposite end including a plurality of bristle brush tufts depending therefrom. The head portion is provided with a plurality of holes, each communicating to the exterior surfaces of the head portion and each communicating with the embedded end of the bristles, embedded within the head. Such holes are adapted to interconnect to the embedded ends of each of the bristle tufts and, if desired, to extend so as to communicate with opposed surfaces of the sides of the head of the brush. The cleaning liquid, either water or a solvent, communicates within the holes, and thence the tufts of the bristles, when the head, without the handle, is stored within a container carrying such cleaning fluid. In this manner, the entire brush head is cleaned whilst it is being stored, occupying a minimum amount of space in the cleaning/storage position.

DETAILED DESCRIPTION OF THE PREFERRED EMBODIMENT

Referring more particularly to the drawings, there is shown a paint brush handle 10 having one distal end that defines a plurality of externally disposed threads 12 thereon. A head or block 14 defines an elongated aperture or open ended channel 16 extending between the top portion 18 and the bottom portion 20 of the head 14. A plurality of tufts 22, each containing a plurality of bristles are axially aligned and spaced apart and depend from the bottom portion 20 of the head 14. The internal wall of the aperture 16, adjacent the opening at the top portion 18, defines a plurality of threads that are adapted to engage the threads 12 on the handle 10. The aperture 16 opening adjacent the top portion 18 has a predetermined internal diameter that is larger than the external diameter of the threaded end of the handle 10. The aperture 16 need not have a uniform cross sectional diameter, but may either taper inwardly, flare outwardly or acutely expand or contract in size below the threaded portion of the aperture 16. A plurality of holes 30 are shown communicating to surface 32 of the head 14, and residing somewhere intermediate regions 18 and 20 thereof. Such holes are shown communicating with the embedded ends 38 of bristles 40. Holes 36, shown in surface 34, of head 14, also appear intermediate ends 18 and 20 of the head and also communicate with the embedded ends of bristles 40. It can be seen that holes 30 and 36 extend at right angles to one another by extending passing through opposed lateral surfaces of head 14. If desired, holes 30 and 36 may communicate with one another or may only communicate with those ends of the bristles, embedded in the head that are arranged in a straight line, extending normal to the surface through which the hole has an opening. When head 14 is stored within container 42, solvent 28, contained therein, enters holes 30 and 36 so as to clean bristles 40 from the ends thereof secured to head 14 whilst cleaning the exposed portions of bristles 40, similarly submerged within solvent 28. Since handle 10 is detached from head 14, container 40 is minimized in size, requiring a smaller amount of solvent 28 to be utilized and limiting the volume of air 44, contained within container 42, thus precluding the buildup of noxious and sometimes highly inflammable vapors therewithin. After the cleaning operation, and presumably when the brush is to be placed into a useable condition, head 14 is removed from container 42, handle 10 is assembled thereto, and the assembly is ready for immediate use. It should be noted that handle 10 may be applied to a plurality of heads 14, not shown, each having a different size, so that a "variety" of paint brushes are available, utilizing only one handle, one container each having easily cleanable heads 14, as shown.

Since it is obvious that numerous changes and modifications can be made in the above-described details without departing from the spirit and nature of the invention, it is to be understood that all such changes and modifications are included within the scope of the invention.

I claim:

1. A paint brush assembly comprising a head portion, a handle portion, said handle portion being removably affixed to said head portion, said head portion having a plurality of bristle brush tufts depending from a first portion of the surface of said head portion, said head portion having a second surface portion extending substantially parallel to the longitudinal axes of said plurality of bristle tufts, said first portion of said surface being adjacent and transverse to said second portion of said surface, one end of each of said bristle brush tufts being embedded in said head passing through said first portion, a first and a second plurality of holes, said first plurality of holes each extending parallel to one another, said second plurality of holes each extending parallel to one another, said first and said second plurality of holes extending transverse to one another, each of said first plurality of holes communicating to each of said second plurality of holes at said each of said one ends of said bristles, each of said first said plurality of holes communicating with said second portion at each of the ends of each of said first plurality of holes, each of said second plurality of holes communicating with said second portion at each of the ends of each of said second plurality of holes.

2. The apparatus as claimed in claim 1 wherein said handle portion has a plurality of threads externally disposed on at least a portion thereof, said head portion having a channel therein, said channel having a predetermined internal diameter greater than the external diameter of said threaded portion of said handle portion.

3. The apparatus as claimed in claim 1 wherein said first and second plurality of tufts are axially aligned.

4. The apparatus as claimed in claim 1 wherein said first and second plurality of holes extend communicating with opposed exterior surfaces of said head portion.

5. The apparatus as claimed in claim 1 further comprising a container, said container having an internal height greater than the distance separating the other end of said plurality of bristle brush tufts and an opposed end of said head portion, wherein said head portion when having said handle portion detached therefrom may be totally carried within said container.

6. The apparatus as claimed in claim 1, wherein said second portion comprises a first pair of opposed parallel surfaces, and a second pair of opposed parallel surfaces, said first pair of parallel surfaces being normal to said second pair of opposed parallel surfaces.

7. The apparatus as claimed in claim 1, wherein said first and second plurality of holes resides in a plane.

8. The apparatus as claimed in claim 7, wherein said plane extends transverse to said second portion.

* * * * *